United States Patent [19]

Mitsui

[11] Patent Number: 4,760,366

[45] Date of Patent: Jul. 26, 1988

[54] FERRITE CORE

[75] Inventor: Tadashi Mitsui, Tokyo, Japan

[73] Assignee: TDK Corporation, Tokyo, Japan

[21] Appl. No.: 46,371

[22] Filed: May 6, 1987

[30] Foreign Application Priority Data

May 7, 1986 [JP] Japan ..... 61-68649[U]

[51] Int. Cl.[4] ..... H01F 27/24; H01F 27/30

[52] U.S. Cl. ..... 336/233; 336/198; 336/212

[58] Field of Search ..... 336/233, 83, 234, 212, 336/225

[56] References Cited

U.S. PATENT DOCUMENTS

| | | | |
|---|---|---|---|
| 3,068,436 | 12/1962 | Holmberg et al. | 336/233 X |
| 4,352,080 | 9/1982 | Mitsui et al. | 336/83 |
| 4,352,081 | 9/1982 | Kijima | 336/233 X |
| 4,424,504 | 1/1984 | Mitsui et al. | 336/233 X |
| 4,583,068 | 4/1986 | Dickens et al. | 336/83 X |

FOREIGN PATENT DOCUMENTS 0068745 1/1983 European Pat. Off. .

*Primary Examiner*—Thomas J. Kozma

*Attorney, Agent, or Firm*—Armstrong, Nikaido, Marmelstein & Kubovcik

[57] ABSTRACT

A ferrite core for the use of a power transformer and/or a choke coil with small size has been found. The core is assembled by a pair of identical core halves (21) together with a bobbin (31) wound a coil. Each of the core halves (21) has an E-shaped structure with a center core (23) on which a coil is wound, a pair of side legs (24) and a base plate (22) which couples the center core (23) with the side legs (24). The cross section of the center core (23) is not circular nor rectangular, but is flat having rectangular portion with a first side (*2a*) and a second side (b−*2a*) and a pair of arcs coupled with said first side. The diameter (*2a*) of the arc is the same as the length of the first side. The transformer is mounted on a printed circuit board so that the axis of the center core (23) is parallel to the printed circuit board. Thus, the height (H) of the transformer is low as compared with that of a prior transformer which has a circular center core. Further, because of the smooth arcs at the corners of the center core, the coil wound on the center core is not damaged, and the coil fits well with the core, resulting the reduction of the undesirable leakage inductance of the transformer.

5 Claims, 3 Drawing Sheets

(a)

(b)

(c)

(a)

(b)

FERRITE CORE

BACKGROUND OF THE INVENTION

The present invention relates to a structure of a ferrite core half, and in particular, relates to such core half for use in forming the cores of a transformer or a choke coil in a power supply circuit. The example of a ferrite core disclosed is intended to be used in a transformer or a choke coil in a power supply circuit capable of handling up to 1 KW.

When used as a power transformer, it may form part of a DC-AC converter and, in this case, a primary power supply is applied to the transformer through a switching circuit to apply an alternate current input to the transformer, and then the required secondary voltage is obtained at the output of the transformer.

A ferrite core for such purposes must satisfy the following conditions.

(a) The core must not magnetically saturate, and preferably, the cross section along the magnetic path is constant along the whole magnetic path in the core.

(b) The core is preferably closed to improve the shield effect so that it does not disturb an external circuit.

(c) The shape of a core is preferably simple and enables a bobbin containing a winding coil or coils to be mounted on it and enables lead wires of the windings to extend outside of the core.

(d) The core is preferably as small and as light in weight as possible. Also, the power handling capacity to weight ratio should be as large as possible.

(e) The height of the transformer composed by the core is as low as possible, so that the transformer may be mounted on a printed circuit board.

The most popular conventional ferrite core has an E-shape having a constant cross section throughout. Alternatively, a combination of an E-shaped and an I-shaped core is used. However, such a combination core has the disadvantages that it is large in size, its shielding effect is not perfect and further, a bobbin to fit over the core and carry the coil windings must be rectangular in cross-section. Thus the windings are bent sharply at the corners of the bobbin and the normal insulation is often damaged, and further, undesirable leakage inductance increases.

We have proposed the improved core in the U.S. Pat. No. 4,352,080, which intends to improve the above condition (e). That core is intended to mount on a printed circuit board so that the core axis is perpendicular to the printed circuit plane. However, it has the disadvantage that the height of the transformer using the core is still high, and therefore, the mounting density of the components of a printed circuit board can not be high.

We have proposed another ferrite core in EP 68745 B1 (U.S. Pat. No. 4,424,504), which is shown in FIGS. 4 and 5. In those figures, the ferrite core 1 has a substantially rectangular base plate 2 which has a recess 2A, a circular center core 3 mounted on the center of the base plate 2, and a pair of side legs 4 mounted on both sides of the base plate 2. The center core 3 is positioned so that it contacts both the recess 2A and one side of the base plate 2. The cross section of each side leg 4 has linear lines 4A, 4B, 4C, a curve 4D, an arc 4E which is parallel with the center core 3, and the linear line 4F between the arc 4E and the line 4C.

The bobbin 11 which fits the core has hollow cylindrical body 12 with a pair of flanges 12A at both the ends of the same, and the terminal plate 13 having a plurality of terminal pins 13A. The terminal plate 13 is composed integrally with the body 12 by using a plastic material. A transformer or a choke coil is obtained by winding a coil on a bobbin into which a pair of cores are inserted. The transformer is mounted on a printed circuit board so that the pins 13A pass through the printed circuit board. The structure of the core of FIGS. 4 and 5 has the advantage that the height of the transformer on a printed circuit board is lower than that of the former one (U.S. Pat. No. 4,352,080), because the core is mounted on a printed circuit board so that the axis of the circular center core 3 is parallel to the plane of the printed circuit board.

However, it still has the disadvantage that the height on a printed circuit board is not low enough for a miniaturized electronic component. When the spacing between printed circuit boards is restricted to 25.4 mm, the height of a transformer on the board must be less than 16 mm, considering the spacing necessary for insulation and soldering.

Another approach for lowering the height of a transformer is the use of a core with a flat center core which has the enough cross sectional area for magnetic flux. However, when the center core is rectangular having sharp corners, it still has the disadvantage that the coil wound on a core can not fit well with the core at the corners, because the coil does not bend at the corners, but curves. So, some spacing is left between a core and a coil, and that spacing increases undesirable leakage inductance. Further, when the corners of the core are sharp, the coil would be injured, and the insulation of the coil would be damaged or destroyed.

SUMMARY OF THE INVENTION

It is an object, therefore, of the present invention to overcome the disadvantages and limitations of a prior ferrite core by providing a new and improved ferrite core.

It is also an object of the present invention to provide a ferrite core which provides a low transformer and or a low choke coil.

It is also an object of the present invention to provide a ferrite core which is small in size, and does not injure a wire of the coil.

The above and other objects are attained by a ferrite core half in a power supply circuit having (a) a center core on which a coil is wound; (b) a pair of side legs positioned at both the sides of said center core; (c) a base plate coupling said center core and said side legs so that said center core and the side legs together with the base plate form essentially an E-shaped structure, and the end portion of said center core, end portions of said side legs and said base plate are all aligned in a single plane; (d) the cross section of said center core being a combination of rectangle having a first side and a second side, and a pair of arcs each coupled with said first side, wherein the diameter of each arc is the same as the length of said first side; (e) the center core being positioned on the base plate so that said second side inscribes with side of the base plate; (f) the cross section of each side leg having a flat outer face and a curved inner face substantially coaxial with the arc of the center core; (g) an empty recess portion being defined by ends of said side legs, and said base plate; and (h) the core half being symmetrical with regard to a first plane including a central axis of the center core and extending parallel to the flat outer faces of the side legs, but is asymmetrical about a second plane including the central axis of the center core and extending perpendicularly to the first plane.

BRIEF DESCRIPTION OF THE DRAWINGS

The foregoing and other objects, features, and attendant advantages of the present invention will be appreciated as the same become better understood by means of the following description and accompanying drawings wherein.

DESCRIPTION OF THE PREFERRED EMBODIMENTS

Figure 1:
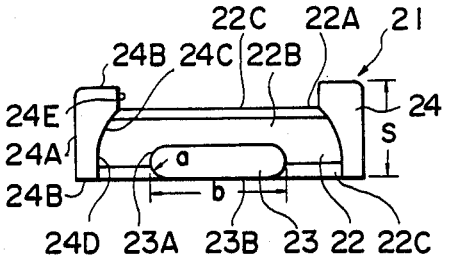
FIG. 1A is an elevational view of a ferrite core half according to the present invention.
FIG. 1B is a bottom view of the ferrite core half of FIG. 1A.
FIG. 1C is a cross sectional view at the line A—A of FIG. 1B.
Figure 1:
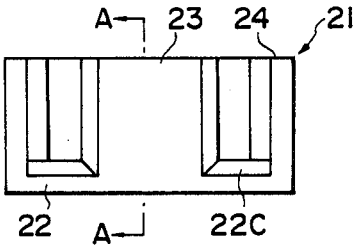
Figure 1:
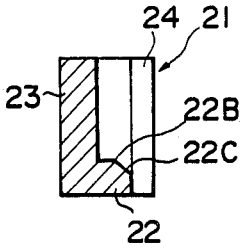
Figure 2:
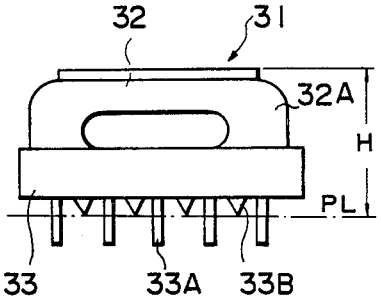
FIG. 2A is an elevational view of a bobbin which fits with the core half of the present invention.
FIG. 2B is a bottom view of the bobbin of FIG. 2A.
Figure 2:
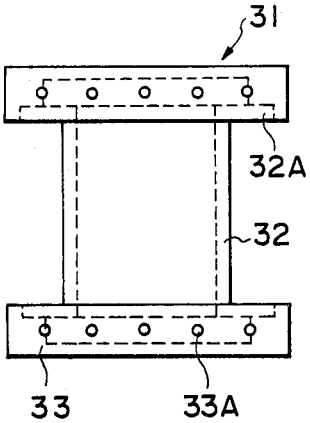
Figure 3:
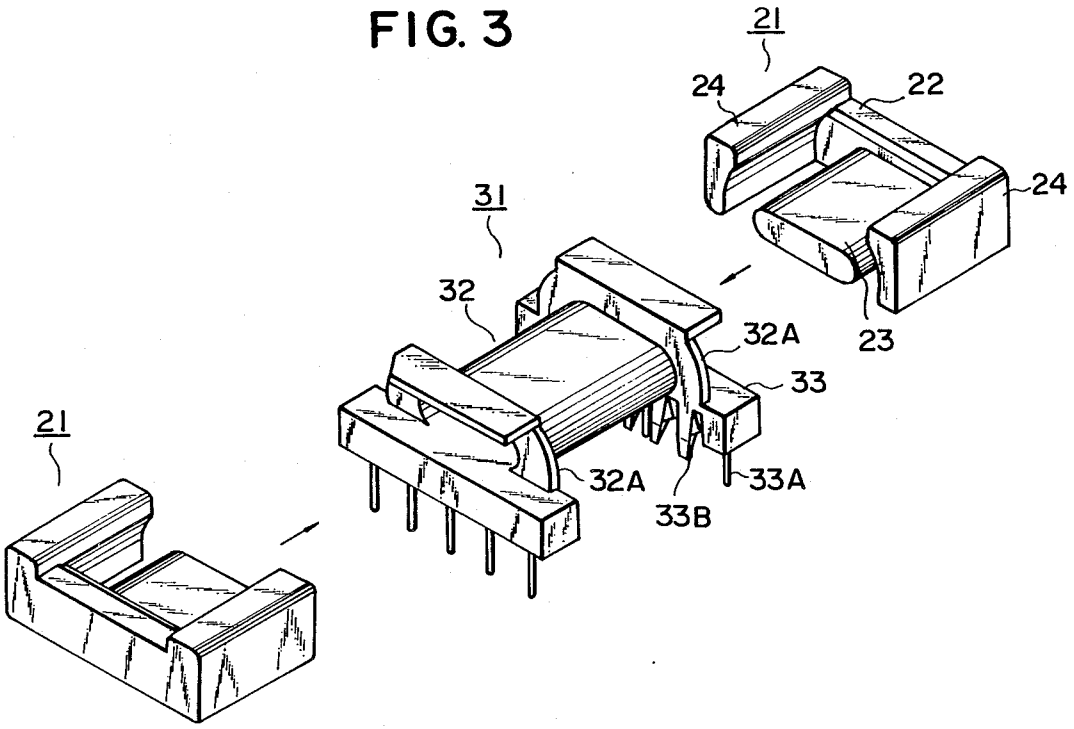
FIG. 3 is a perspective view of a transformer using the present cores, omitting a coil.

FIG. 1A is an elevational view of the present core half, FIG. 1B is a bottom view of the present core half, and FIG. 1C is a cross sectional view at the line A—A of FIG. 1B. FIGS. 2A and 2B show a bobbin, and FIG.3 shows a perspective view of transformer using the cores of FIGS. 1A through 1C and the bobbin of FIGS. 2A and 2B. In the figures, the ferrite core half 21 according to the present invention has an essentially rectangular base plate 22 made of a ferrite material, a center core 23 mounted on the center of the base plate 22, and a pair of side legs 24 mounted at the ends of the base plate 22. Those members 22, 23 and 24 are integrally molded by using a ferrite material. The center core 23 is positioned on the base plate 22 so that the center core 23 inscribes with the side of the base plate 22.

Figure 4:
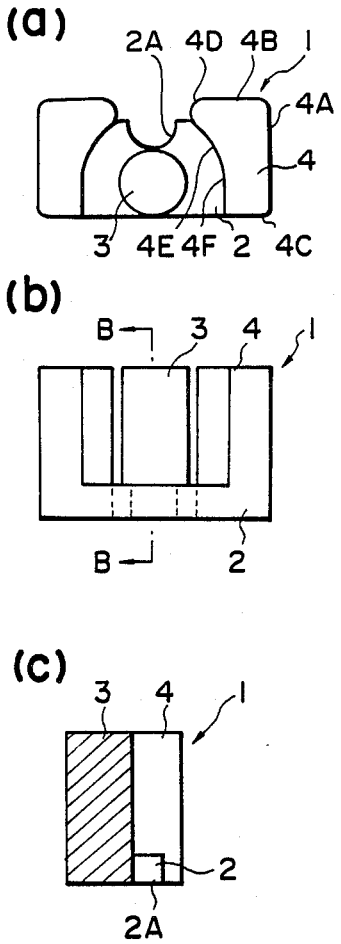
FIG. 4 PRIOR ART
FIG. 4A is an elevational view of the prior ferrite core.
FIG. 4B is a bottom view of FIG. 4A.
FIG. 4C is a cross sectional view at the line B—B of FIG. 4B.
Figure 5:
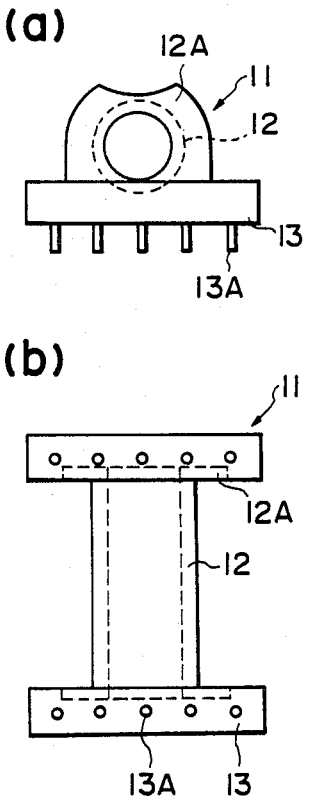
FIG. 5 PRIOR ART
FIG. 5A is a side view of a bobbin for the use with the core of FIGS. 4A through 4C.
FIG. 5B is a bottom view of the bobbin of FIG. 5A.

The cross section of the center core 23 is not rectangular, nor circular, but it is flat with curved corners. Preferably, that cross section is the combination of a pair of arcs 23A with radius (a), and a rectangle with the first side of the length (2a) and the second side of the length (b−2a). The area of the cross section of the center core 23 is $2a(b-2a)+\pi a^2$, which must be enough for the path of the magnetic flux. In other words, when the core is designed, the cross sectional area is first determined so that the magnetic flux in the core does not saturate in operation, and it should be noted that the diameter (2a) of the center core 23 is smaller than that of a circular center core of FIG. 4A. That flat center core is the important feature of the present invention.

Further, it should be appreciated that the center core 23 of the present invention has no sharp edges, but is has a pair of arcs 23A. Because of no sharp edges, a wire of a coil wound on the center core is not injured. Further, the shape of a coil wound on the center core fits well with the shape of the center core. This fact provides the further small size of a transformer, and reduction of undesirable leakage inductance. If the cross section of the center core is rectangular, the coil would not fit with the shape of the core, but some spacing would be left between the center core and the coil.

The cross section of each of side legs 24 has the linear line 24A which inscribes with the short side of the base plate 22, a pair of linear lines 24B which is parallel to the long side of the base plate 22, and arc 24C which is parallel or coaxial with the arc 23A of the center core 23, a linear line 24D between the end of the arc 23C and the line 24B, and another linear line 24E between the other end of the arc 23C and the line 24B. The side legs 24 are positioned so that the linear line 24B inscribes with the base plate 22, or that linear line 24B is on the extension of the linear line of the center core 23.

The length of the line 24A is longer than the short side of the base plate 22, so that a recess area 22A is defined by a pair of side legs 24 and the base plate 22. The depth of the recess is preferably the same as the thickness of a flange of the bobbin.

The cross section of the base plate 22 has a step 22B, and the end of the base plate 22 has a slanted slope 22C, so that no sharp edge of the base plate is provided. That slanted slope 22C is advantageous in the manufacturing process of the core in extracting the core from a die in the molding process.

In order to provide enough reduction of height of a transformer, it is preferable that the length (b) is considerably longer than the radius (a). In a preferable embodiment, the ratio of (b) which is the lateral length of the center core, to (2a) which is the height of the center core, is larger than 1.2, and still preferably, that ratio is larger than 2.0.

A pair of ferrite core halves of FIGS. 1A through 1C are coupled with a bobbin in FIGS. 2A and 2B, after a coil is wound on the bobbin. The bobbin 31 has a hollow cylindrical body 32 and a pair of flanges 32A at both the ends of the body 32, and a terminal plate 33 having a plurality of terminal pins 33A. The internal cross section of the cylindrical body 32 is the same as the cross section of the center core 23 of a core half. Preferably, the terminal plate 33 has some stoppers 33B extending in the same direction as pins 33A. The bobbin having the cylindrical body 32, the flanges 31, and the terminal plate 33 having stoppers 33B and pins 33A is integrally composed of a dielectric plastic.

It should be noted that the external shape of the cylindrical body 32 of the bobbin has no sharp edges because of the curved structure of the center core, and therefore, the coil wound on the bobbin is not injured, and no spacing is left between the bobbin (or the core) and the coil, since a coil does not bend but fits well to the profile of the bobbin.

When the coil is wound on the bobbin, a pair of ferrite core halves are inserted in the bobbin so that the center cores 23 of two core halves touch each other in the hollow cylindrical body 32 of the bobbin. It should be appreciated of course that the side legs of two core halves also touch each other, since the height of the center core is the same as that of the side legs.

The assembled transformer or choke coil is mounted on a printed circuit board, so that the pins 33A pass through the printed circuit board. In this case, the stoppers 33B define the level of the transformer, by abutting a printed circuit board PL. Therefore, it should be noted that the total height H of the transformer on the printed circuit board is the length between the end of the stopper 33B and the top of the flanges 32A. That height H may be less than 16 mm when the capacity of the transformer is up to 100 watts, and so, the printed circuit board may be mounted with the interval of 25.4 mm.

Preferably, the cross sectional area along the magnetic path in the core is uniform, so that no magnetic saturation occurs. In that regard, it is preferable that cross sectional area of the center core 23 is the same as the cross sectional area of the base plate 22, and it is also the same as the sum of the cross sectional areas of the side legs 24. However, when the core half is not large, the size of the side leg may be larger than that defined by magnetic flux saturation condition mentioned above, because the side legs designed by the above condition would be too small to have the necessary mechanical strength.

It should be noted that the height S of the side leg 24 is longer than (2a) which is the height of the center core 23. That relationship allows a reduction in the leakage inductance of the transformer, because the flux from the center core 23 is well received by the large side legs through the base plate 22.

As described above in detail, the present invention provides a core half for a transformer or a choke coil which is low when mounted on a printed circuit board, by mounting the cores so that the axis of the center cores are positioned parallel to the printed circuit board. As the cross section of the center core is flat, but not circular, the height is further reduced. Further, as the corners of the center core are not sharp, but smooth arc, the coil wound on the cores is not injured, and fits well with the cores. This reduces not only the size of the transformer, but also the undesirable leakage inductance of the transformer.

From the foregoing it will now be apparent that a new and improved core half has been found. It should be understood of course that the embodiments disclosed are merely illustrative and not intended to limit the scope of the invention. Reference should be made to the appended claims, therefore, rather than the specification as indicating the scope of the invention.

What is claimed is:

1. A ferrite core half for use in a power supply circuit, comprising (a) a center core on which a coil is wound, (b) a pair of side legs positioned at both the sides of said center core, (c) a base plate coupling said center core and said side legs so that said center core and the side legs together with the base plate form essentially an E-shaped structure, and an end portion of said center core, end portions of said side legs and said base plate are all aligned in a single plane, wherein the improvement comprises:

(d) a cross section of said center core is represented by a combination of a rectangle having a first side (2a) and a second side (b−2a), and a pair of arcs each coupled with said first side, wherein the diameter (2a) of each arc is the same as the length of the first side, (e) the center core is positioned on the base plate so that said second side inscribes with side of the base plate, (f) a cross section of each side leg has a flat outer face and curved inner face substantially coaxial with the arc of the center core, (g) an empty recess portion is defined by ends of said side legs, and said base plate, (h) the core half is symmetrical with regard to a first plane including a central axis of the center core and extending parallel to the flat outer faces of the side legs, but is asymmetrical about a second plane including the central axis of the center core and extending perpendicularly to the first plane, (i) a side of said empty recess portion formed in said base plate is flat and disposed parallel to said second side of said center core, and (j) wherein a height of a transformer using said core half is defined by the length of a linear line of the outside of the side leg of said core half.

2. A ferrite core according to claim 1, wherein said cross section of said side leg has a linear face facing said empty recess, and another linear face (24D) close to end of the side leg.

3. A ferrite core half according to claim 1, wherein a step is provided on the base plate between said center core and said empty recess.

4. A ferrite core half according to claim 1, wherein a corner of said base plate has slanted portion.

5. A ferrite core half according to claim 1, wherein ratio of (b) which is lateral length of the center core, to (2a) which is diameter of said arc, is larger than 1.2.

* * * * *